US007438002B2

(12) United States Patent
Murray

(10) Patent No.: US 7,438,002 B2
(45) Date of Patent: Oct. 21, 2008

(54) DESKTOP

(76) Inventor: David A. Murray, 39 Cross Hwy., Westport, CT (US) 06380

( * ) Notice: Subject to any disclaimer, the term of this patent is extended or adjusted under 35 U.S.C. 154(b) by 129 days.

(21) Appl. No.: 11/444,647

(22) Filed: May 31, 2006

(65) Prior Publication Data

US 2007/0277708 A1 Dec. 6, 2007

(51) Int. Cl.
*A47B 57/00* (2006.01)

(52) U.S. Cl. ..... 108/50.01; 312/195; 312/107; 108/64

(58) Field of Classification Search ..... 108/50.01, 108/50.02, 64–66, 69; 52/36.1, 239; 312/194–196, 312/223.3, 223.6, 107–111; D6/421–431, D6/474, 480, 482–485, 487, 490, 491, 509–511
See application file for complete search history.

(56) References Cited

U.S. PATENT DOCUMENTS

D242,832 S * 12/1976 Swensson ..... D6/423
4,879,955 A * 11/1989 Moll et al. ..... 108/50.02
D332,954 S * 2/1993 Sanvito ..... D15/66
D346,912 S * 5/1994 Mezger ..... D6/423
D366,373 S * 1/1996 Reese ..... D6/427
5,743,193 A * 4/1998 Kakuta et al. ..... 108/147
D394,569 S * 5/1998 O'Malley ..... D6/511
5,992,332 A * 11/1999 Grabowski ..... 108/64
6,282,854 B1 * 9/2001 Vos et al. ..... 52/239
6,286,275 B1 * 9/2001 Edwards ..... 52/238.1
6,453,826 B1 * 9/2002 Fookes et al. ..... 108/50.11
6,701,682 B2 * 3/2004 Ando et al. ..... 52/234
6,712,470 B2 * 3/2004 O'Brien et al. ..... 351/245

* cited by examiner

*Primary Examiner*—Janet M Wilkens
(74) *Attorney, Agent, or Firm*—Anthony P. Gangemi; Wiggin and Dana LLP

(57) ABSTRACT

A desktop including a first portion and a diagonal portion oriented diagonally with respect to the first portion. Both the first portion and diagonal portion each have a top surface, a bottom surface opposite said top surface, a plurality of side surfaces, and first and second longitudinal axes, respectively, that substantially bisect each portion. The first portion and diagonal portion are oriented so that the first longitudinal axis and the second longitudinal axis are diagonal to one another. The desktop also includes a return portion having a top surface, a bottom surface opposite the top surface, and a plurality of side surfaces. The return portion is joined with the first portion and has a third longitudinal axis that substantially bisects the top surface of the return portion. The third longitudinal axis is substantially perpendicular to the first longitudinal axis.

22 Claims, 3 Drawing Sheets

DESKTOP

BACKGROUND OF THE INVENTION (1) Field of the Invention

The present invention generally relates to a desktop. In particular, the present invention is directed to a desktop having a first portion and a diagonal portion oriented diagonally with respect to the first portion.

(2) Description of the Related Art

Traditional office furniture systems include standard desks with or without returns or credenzas. Such traditional office furniture systems typically require a larger office footprint and do not efficiently use office space overall.

To provide for more efficient use of office space, L-shaped and U-shaped workstation-like office furniture systems were developed. Such systems are typically dimensioned according to the surrounding office dimensions. Unfortunately, such systems generally create a barrier that pushes people away and creates unproductive workspace. Guests generally have little or no access to a user or worker's work area without standing directly behind the user. Finally, guest often have little or now work area and multiple guests are often required to sit close to one another.

BRIEF SUMMARY OF THE INVENTION

One aspect of the present invention is a desktop including a first portion having a top surface, a bottom surface opposite the top surface, and a plurality of side surfaces. The first portion includes a first longitudinal axis that substantially bisects the top surface. The desktop also includes a diagonal portion having a top surface, a bottom surface opposite the top surface, and a plurality of side surfaces. The diagonal surface is joined with the first portion and includes a second longitudinal axis that substantially bisects the top surface of the diagonal portion. The first portion and the diagonal portion are oriented so the first longitudinal axis and the second longitudinal axis are diagonal to one another.

Another aspect of the invention is a desktop including a first portion having a top surface, a bottom surface opposite the top surface, and a plurality of side surfaces. The first portion includes a first longitudinal axis that substantially bisects the top surface of the first portion. The desktop includes a diagonal portion having a top surface, a bottom surface opposite the top surface, and a plurality of side surfaces. The diagonal surface is joined with the first portion and includes a second longitudinal axis. The second longitudinal axis substantially bisects said top surface of the diagonal portion. The first portion and diagonal portion are oriented so the first longitudinal axis and the second longitudinal axis are diagonal to one another. The desktop also includes a return portion having a top surface, a bottom surface opposite the top surface, and a plurality of side surfaces. The return portion is joined with the first portion and has a third longitudinal axis. The third longitudinal axis substantially bisects the top surface of the return portion and is substantially perpendicular to the first longitudinal axis. At least one of the plurality of side surfaces of the first portion and at least one of the plurality of side surfaces of the diagonal portion define a worker-side edge. The worker-side edge has a predetermined curvature that is configured so that the worker-side edge radiates toward the first longitudinal axis and the second longitudinal axis.

Yet another aspect of the present invention is a modular office system, which includes a plurality of walls and a desktop. The plurality of walls define an at least partially enclosed, substantially parallelogram-shaped office area and each of the plurality of walls defines an axis. The desktop includes a first portion and a diagonal portion. The first portion has a top surface, a bottom surface opposite the top surface, and a plurality of side surfaces. The first portion has a first longitudinal axis that substantially bisects it. The first longitudinal axis is substantially parallel to one of the axes defined by one of the plurality of walls. The diagonal portion has a top surface, a bottom surface opposite the top surface, and a plurality of side surfaces. The diagonal portion is joined with the first portion and defines a second longitudinal axis. The second longitudinal axis substantially bisects the top surface of the diagonal portion and is substantially parallel to a different one of the axes defined by one of the plurality of walls than the first longitudinal axis. The first portion and the diagonal portion are oriented so the first longitudinal axis and the second longitudinal axis are diagonal to one another.

BRIEF DESCRIPTION OF THE DRAWINGS

For the purpose of illustrating the invention, the drawings show a form of the invention that is presently preferred. However, it should be understood that the present invention is not limited to the precise arrangements and instrumentalities shown in the drawings, wherein.

DETAILED DESCRIPTION

Figure 1:
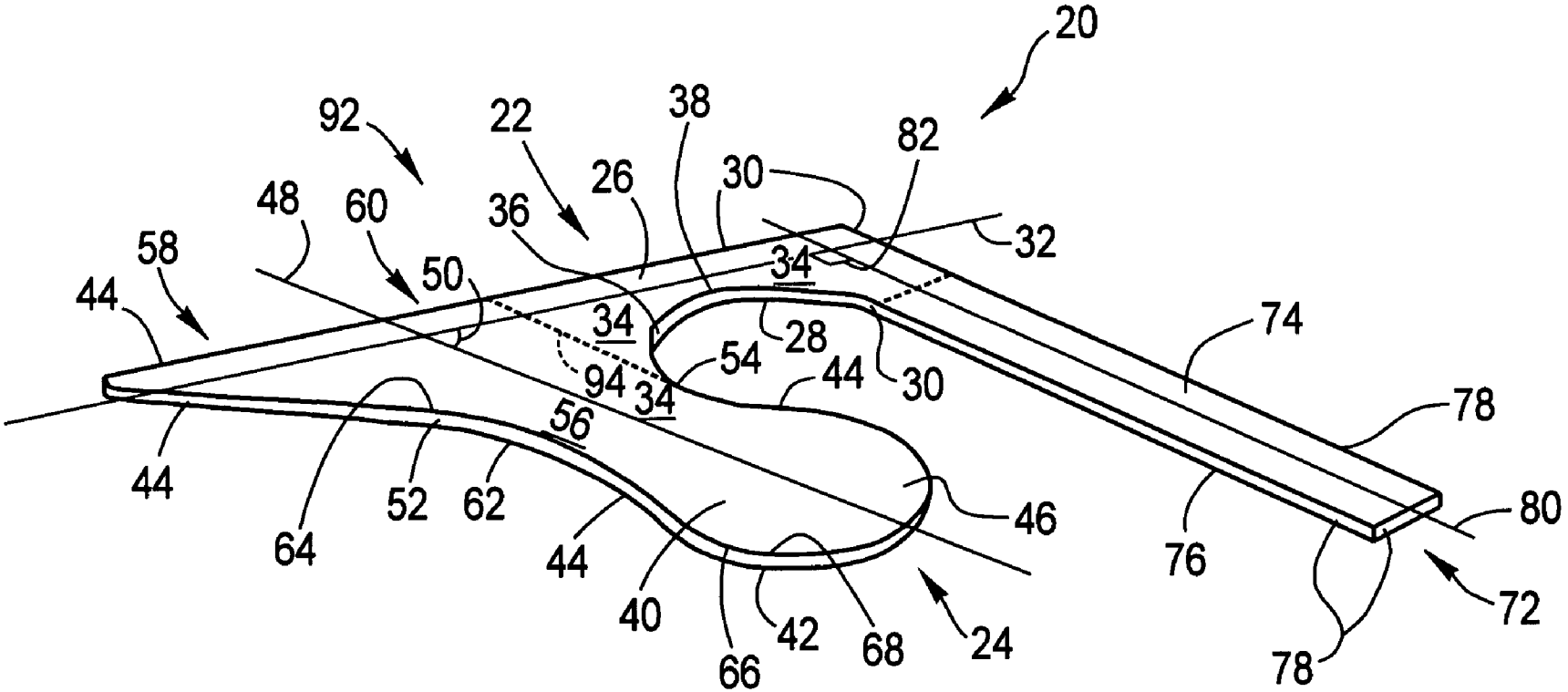
FIG. 1 is a front isometric view of a desktop according to one embodiment of the present invention.
Figure 2:
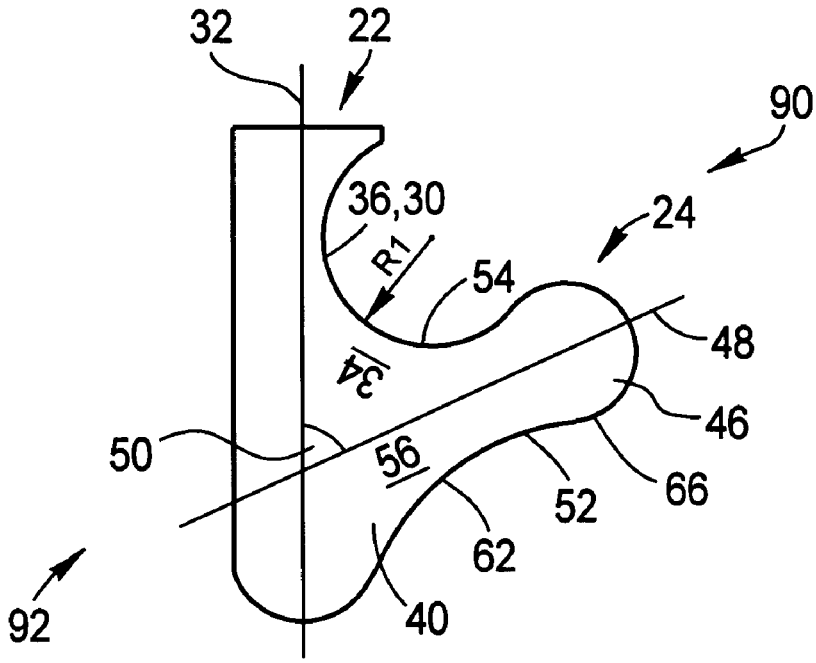
FIG. 2 is a top view of a desktop according to one embodiment of the present invention.
Figure 3:
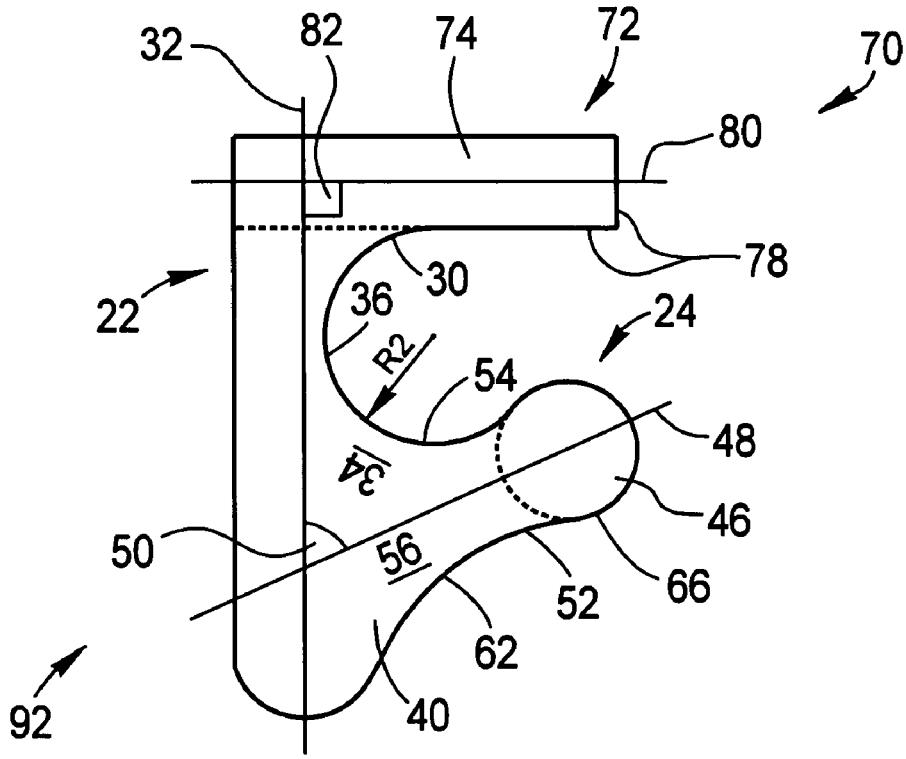
FIG. 3 is a top view of a desktop according to one embodiment of the present invention.

Referring now to the drawings in which like reference numerals indicate like parts, and in particular, to FIGS. 1-3, one aspect of the present invention is a desktop 20. In one embodiment, desktop 20 includes a first portion 22 and a diagonal portion 24 that is oriented so as to be diagonal to the first portion.

First portion 22 includes a top surface 26, a bottom surface 28, which is opposite and typically a mirror image of the top surface, and a plurality of side surfaces 30. First portion 22 generally extends along a first longitudinal axis 32 that may substantially bisect top surface 26. First portion 22 is generally adapted or configured to include a worker work area 34. At least one of plurality of side surfaces 30 may define a worker-side edge 36. Worker-side edge 36 typically has a predetermined curvature 38. The shape of predetermined curvature 38 is generally selected so that worker-side edge 36 radiates toward first longitudinal axis 32.

Diagonal portion 24 includes a top surface 40, a bottom surface 42, which is opposite and typically a mirror image of the top surface, and a plurality of side surfaces 44. At least one end of diagonal portion 24 may be defined by or include a pedestal portion 46, which may or may not be contiguous to the diagonal portion. Diagonal portion 24 generally extends along a second longitudinal axis 48 that may substantially bisect top surface 40 of the diagonal portion. First portion 22 and diagonal portion 24 are typically oriented so that first longitudinal axis 32 and second longitudinal axis 48 are diagonal to one another. In one embodiment, first portion 22 and diagonal portion 24 are oriented to define an angle 50 between first longitudinal axis 32 and second longitudinal axis 48 that is less than 90 degrees. In another embodiment, angle 50 is about 50 to 70 degrees. In still another embodiment, angle 50 is about 60 degrees.

At least one of plurality of side surfaces 44 is joined with at least one of plurality of side surfaces 30 to define worker-side edge 36. In addition to generally radiating toward first longitudinal axis 32, predetermined curvature 38 is selected so worker-side edge 36 also generally radiates toward second longitudinal axis 48. At least one of plurality of side surfaces 44 may define a guest-side edge 52 that is substantially opposite a portion 54 of worker-side edge 36. A guest work area 56 is defined substantially on a half 58 of diagonal portion 24 between second longitudinal axis 48 and guest-side edge 52. A remaining portion 60 of diagonal portion 24 defines additional worker work area 34. Guest-side edge 52 may include at least one portion 62 with a predetermined curvature 64 that is selected so that the at least one portion radiates toward second longitudinal axis 48. Guest-side edge 52 may also include at least one portion 66 with a predetermined curvature 68 that is selected so that the at least one portion radiates toward second longitudinal axis 48.

As illustrated in FIGS. 1 and 3, desktops 20 and 70 may also include a return portion 72. Return portion 72 typically includes a top surface 74, a bottom surface 76, which is opposite and typically a mirror image of the top surface, and a plurality of side surfaces 78. Return portion 72 generally extends along a third longitudinal axis 80 that substantially bisects top surface 74 of the return portion. Typically, third longitudinal axis 80 is substantially perpendicular to first longitudinal axis 32. In at least one embodiment, angle 50 between first longitudinal axis 32 and second longitudinal axis 48 is less than a second angle 82 defined between the first longitudinal axis and third longitudinal axis 80.

Diagonal portion 24 is generally joined with first portion 22. In FIGS. 1-3, which illustrate desktops 20, 90, and 70, respectively, first portion 22 and diagonal portion 24 may be defined by a single, contiguous portion 92. As indicated by dashed line 94 in FIG. 1, in other embodiments such as desktop 20, first portion 22 and diagonal portion 24 may not be contiguous and may be two separate portions that are positioned adjacent one another. Desktops 20 and 70, which include a return portion 72, may be configured so that first portion 22, diagonal portion 24, and the return portion are defined by a single, contiguous portion. Desktops 20 and 70 may also be configured so that first portion 22, diagonal portion 24, and return portion 72 are separate portions positioned adjacent to one another. Alternatively, as illustrated in FIG. 2, desktop 90 may only include first portion 22 and diagonal portion 24 and not include return portion 72.

Desktops 20, 70, and 90 may generally be dimensioned according to the required dimensions of the surrounding work area and the user. Typically, first portion 22 is shorter than both return portion 72 and diagonal portion 24. First portion 22 generally has a length from about five feet to six feet. Diagonal portion 24 generally has a length from about eight feet to ten feet. The length of return portion 72 may vary as illustrated in FIGS. 1 and 3 and is generally from about three feet to seven feet. Radii R1 and R2 of predetermined curvatures 38 and 68, respectively, may also vary but are generally from about two feet to three feet and five feet to six feet, also respectively.

Figure 4:
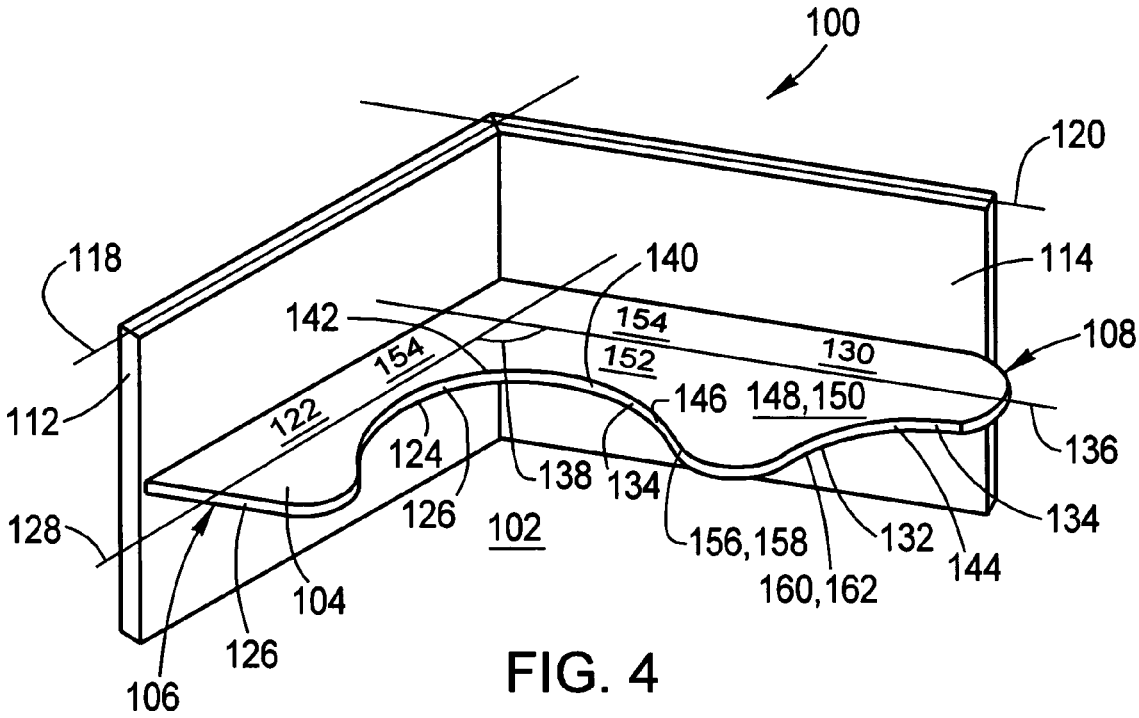
FIG. 4 is a front isometric view of a modular office system according to one embodiment of the present invention.
Figure 5:
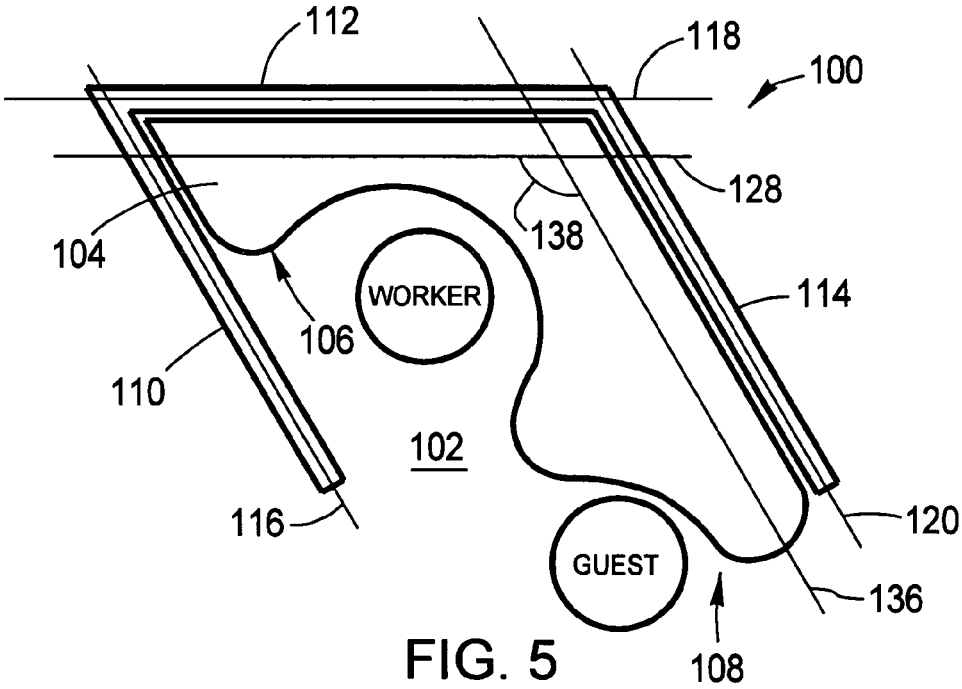
FIG. 5 is a top view of a desktop according to one embodiment of the present invention.

Referring now to FIGS. 4 and 5, another embodiment of the present invention is a modular office system 100, which generally includes a substantially parallelogram-shaped office area 102 having a desktop 104 with a first portion 106 and a diagonal portion 108 positioned therein.

Substantially parallelogram-shaped office area 102 is defined by a plurality of walls 110, 112, 114. Each of plurality of walls 110, 112, 114 defines a respective axis 116, 118, 120.

First portion 106 of desktop 104 includes a top surface 122, a bottom surface 124 opposite the top surface, and a plurality of side surfaces 126. First portion 106 defines a first longitudinal axis 128 that substantially bisects top surface 122. First longitudinal axis 128 is generally substantially parallel to one of axes 116, 118, 120, e.g., axis 118 in FIGS. 4 and 5.

Diagonal portion 108 of desktop 104 includes a top surface 130, a bottom surface 132 opposite the top surface, and a plurality of side surfaces 134. Diagonal portion 108 is typically joined with first portion 106. Diagonal portion 108 defines a second longitudinal axis 136 that substantially bisects top surface 130. Second longitudinal axis 136 is generally substantially parallel to a different one of axes 116, 118, 120 than first longitudinal axis 128, e.g., axis 120 in FIGS. 4 and 5. As a result, first portion 106 and diagonal portion 108 are generally oriented so first longitudinal axis 128 and second longitudinal axis 136 are diagonal to one another. In one embodiment, first portion 106 and diagonal portion 108 are oriented to define an angle 138 between the first longitudinal axis and the second longitudinal axis that is greater than 90 degrees. In one embodiment, angle 138 is about 110 to 130 degrees. In another embodiment, angle 138 is about 125 degrees.

At least one of plurality of side surfaces 126 is joined with at least one of plurality of side surfaces 134 to define worker-side edge 140. In addition to generally radiating toward first longitudinal axis 128, a predetermined curvature 142 is selected so worker-side edge 140 also generally radiates toward second longitudinal axis 136. At least one of plurality of side surfaces 134 may define a guest-side edge 144 that is substantially opposite a portion 146 of worker-side edge 140. A guest work area 148 is defined substantially on a portion 150 of top surface 130 of diagonal portion 108 adjacent guest-side edge 144. A remaining portion 152 of diagonal portion 108 defines a portion of worker work area 154. Guest-side edge 144 may include at least one portion 156 with a predetermined curvature 158 that is selected so that the at least one portion radiates toward first longitudinal axis 128. Guest-side edge 144 may also include at least one portion 160 with a predetermined curvature 162 that is selected so that the at least one portion radiates toward second longitudinal axis 136.

Many aspects of desktop 104 are similar to similar aspects of desktops 20, 70, and 90. Desktop 104 is typically sized similarly to desktops 20, 70, and 90 or in accordance with the dimensions of a respective substantially parallelogram-shaped office area 102 in which it is positioned. Exemplary dimensions for one substantially parallelogram-shaped office area 102 includes two sides having a length of about five to seven feet and two sides having a length of about six feet to nine feet. In one embodiment, two sides are six feet and two sides are seven and one-half feet.

Desktops according to the present invention are typically fabricated from solid wood and/or composite wood materials. Generally, all of the surfaces of the present invention are flat and/or smooth. However, desktops according to the present invention may also be fabricated from plastic, metal, stone, and any other material that both includes substantially flat surfaces and may be fabricated according to the geometrical configurations of the present invention.

The desktop of the present invention offers advantages over existing desktop and related office furniture systems. A 9'×12' office space including an office furniture system with a desktop according to the present invention generally provides up to 40% more useful surface space over traditional U-shaped office furniture systems. The inward curves of both the diagonal portion and first portion encourage collaboration and maximize workspace for both the worker/user and guests. The outward curves of the diagonal portion generally provide guests with arm space, additional work areas over existing systems, and comfortable separation between one another. The inward and outward curves result in a distance between users that is much more personal and induces more of a side-by-side feeling rather than an oppositional feeling. The diagonal orientation of the diagonal portion with respect to the first portion allows guests to more easily view a computer monitor of the worker/user.

Although the invention has been described and illustrated with respect to exemplary embodiments thereof, it should be understood by those skilled in the art that the foregoing and various other changes, omissions and additions may be made therein and thereto, without parting from the spirit and scope of the present invention. Accordingly, other embodiments are within the scope of the following claims.

What is claimed is:

1. A desktop comprising:

a first portion having a top surface, a bottom surface opposite said top surface, and a plurality of side surfaces, said first portion having a first longitudinal axis, said first longitudinal axis substantially bisecting said top surface of said first portion; and a diagonal portion having a top surface, a bottom surface opposite said top surface, and a plurality of side surfaces, said diagonal portion being joined with said first portion, said diagonal portion having a second longitudinal axis, said second longitudinal axis substantially bisecting said top surface of said diagonal portion, wherein said first portion and said diagonal portion are oriented so said first longitudinal axis and said second longitudinal axis are diagonal to one another; and a return portion having a top surface, a bottom surface opposite said top surface, and a plurality of side surfaces, said return portion being joined with said first portion, said return portion having a third longitudinal axis, said third longitudinal axis substantially bisecting said top surface of said return portion, wherein said third longitudinal axis is substantially perpendicular to said first longitudinal axis;

wherein said angle between said first longitudinal axis and said second longitudinal axis is less than a second angle defined between said first longitudinal axis and said third longitudinal axis.

2. A desktop according to claim 1, wherein said first portion and said diagonal portion are oriented to define an angle between said first longitudinal axis and said second longitudinal axis that is less than 90 degrees.

3. A desktop according to claim 2, wherein said angle between said first longitudinal axis and said second longitudinal axis is about 50 to 70 degrees.

4. A desktop according to claim 3, wherein said angle between said first longitudinal axis and said second longitudinal axis is about 60 degrees.

5. A desktop according to claim 1, wherein at least one of said plurality of side surfaces of said first portion and at least one of said plurality of side surfaces of said diagonal portion define a worker-side edge, which has a predetermined curvature.

6. A desktop according to claim 5, wherein said predetermined curvature is configured so that said worker-side edge radiates toward said first longitudinal axis and said second longitudinal axis.

7. A desktop according to claim 1, wherein said first portion is shorter than said return portion and said diagonal portion.

8. A desktop according to claim 1, wherein said first portion is adapted to include a worker work area.

9. A desktop according to claim 1, wherein at least one of said plurality of side surfaces of said diagonal portion define a guest-side edge, which has at least one portion with a predetermined curvature.

10. A desktop according to claim 9, wherein said predetermined curvature is selected so that at least a portion of said guest-side edge radiates toward said second longitudinal axis.

11. A desktop according to claim 9, wherein said predetermined curvature is selected so that at least a portion of said guest-side edge radiates away from said second longitudinal axis.

12. A desktop according to claim 9, wherein said diagonal portion is adapted to include a guest work area that is substantially on a half of said diagonal portion defined between said second longitudinal axis and said guest-side edge.

13. A desktop according to claim 1, wherein said first portion and said diagonal portion are defined by a single, contiguous portion.

14. A desktop according to claim 1, wherein said first portion, said diagonal portion, and said return portion are defined by a single, contiguous portion.

15. A desktop according to claim 1, wherein an end of said diagonal portion includes a pedestal portion.

16. A desktop comprising:

a first portion having a top surface, a bottom surface opposite said top surface, and a plurality of side surfaces, said first portion having a first longitudinal axis, said first longitudinal axis substantially bisecting said top surface of said first portion;

a diagonal portion having a top surface, a bottom surface opposite said top surface, and a plurality of side surfaces, said diagonal portion being joined with said first portion, said diagonal portion having a second longitudinal axis, said second longitudinal axis substantially bisecting said top surface of said diagonal portion, wherein said first portion and said diagonal portion are oriented so said first longitudinal axis and said second longitudinal axis are diagonal to one another; and a return portion having a top surface, a bottom surface opposite said top surface, and a plurality of side surfaces, said return portion being joined with said first portion, said return portion having a third longitudinal axis, said third longitudinal axis substantially bisecting said top surface of said return portion, wherein said third longitudinal axis is substantially perpendicular to said first longitudinal axis;

wherein at least one of said plurality of side surfaces of said first portion and at least one of said plurality of side surfaces of said diagonal portion define a worker-side edge, which has a predetermined curvature that is configured so that said worker-side edge radiates toward said first longitudinal axis and said second longitudinal axis and wherein said first portion and said diagonal portion are oriented to define an angle between said first longitudinal axis and said second longitudinal axis that is less than 90 degrees.

17. A desktop according to claim 16, wherein at least one of said plurality of side surfaces of said diagonal portion define a guest-side edge, which has at least one portion with a predetermined curvature.

18. A desktop according to claim 17, wherein said predetermined curvature is selected so that at least a portion of said guest-side edge radiates toward said second longitudinal axis.

19. A desktop according to claim 17, wherein said predetermined curvature is selected so that at least a portion of said guest-side edge radiates away from said second longitudinal axis.

20. A desktop according to claim 17, wherein said diagonal portion is adapted to include a guest work area that is substantially on a half of said diagonal portion defined between said second longitudinal axis and said guest-side edge.

21. A desktop according to claim 16, wherein said angle between said first longitudinal axis and said second longitudinal axis is about 50 to 70 degrees.

22. A desktop according to claim 21, wherein said angle between said first longitudinal axis and said second longitudinal axis is about 60 degrees.

* * * * *